US007337508B2

(12) United States Patent
Takasawa et al.

(10) Patent No.: US 7,337,508 B2
(45) Date of Patent: Mar. 4, 2008

(54) ZIP FASTENER WITH EMERGENCY OPENING FACILITY

(75) Inventors: Shigeyoshi Takasawa, Runcorn (GB); Mark Davies, Runcorn (GB); Shunji Akashi, Runcorn (GB)

(73) Assignee: YKK Corporation, Tokyo (JP)

( * ) Notice: Subject to any disclaimer, the term of this patent is extended or adjusted under 35 U.S.C. 154(b) by 222 days.

(21) Appl. No.: 11/166,870

(22) Filed: Jun. 24, 2005

(65) Prior Publication Data

US 2006/0000065 A1 Jan. 5, 2006

(30) Foreign Application Priority Data

Jul. 2, 2004 (GB) ..... 0414935.7

(51) Int. Cl.
*A44B 19/00* (2006.01)
*A44B 19/02* (2006.01)

(52) U.S. Cl. ..... 24/401

(58) Field of Classification Search ..... 24/401, 24/402, 404, 406, 408, 409, 410, 411, 412, 24/413, 591.1
See application file for complete search history.

(56) References Cited

U.S. PATENT DOCUMENTS

| | | | | |
|---|---|---|---|---|
| 2,013,071 | A * | 9/1935 | Sipe | 24/401 |
| 3,122,808 | A | 3/1964 | Maschi et al. | |
| 4,236,284 | A | 12/1980 | Kamiya | |
| 4,349,943 | A * | 9/1982 | Moertel | 24/410 |
| 4,520,535 | A | 6/1985 | Kasai | |
| 5,836,058 | A * | 11/1998 | Cullum | 24/401 |
| 6,243,927 | B1 * | 6/2001 | Matsushima et al. | 24/401 |
| 7,036,190 | B2 * | 5/2006 | Demarest | 24/401 |

FOREIGN PATENT DOCUMENTS

| | | |
|---|---|---|
| GB | 678755 | 9/1952 |
| GB | 1 480 176 | 7/1977 |
| GB | 1 514 296 | 6/1978 |
| WO | WO 00/35719 | 6/2000 |

* cited by examiner

*Primary Examiner*—Robert J. Sandy
(74) *Attorney, Agent, or Firm*—Alston & Bird LLP

(57) ABSTRACT

In a zip fastener the elements (10) on one tape have a head which engages a shoulder (20) of an opposed element to limit out of plane movement. A small number of elements (30) have a head (38) which bears on a shoulder 46 when twisted in one direction but passes the shoulder (46) when twisted in the opposite direction to allow partial separation of the elements to create a point of weakness. The coupled elements can be peeled apart when sufficient pressure is applied to one side of the tape at the point of weakness, but the elements resist twisting when pressure is applied to the opposite side.

6 Claims, 8 Drawing Sheets

ZIP FASTENER WITH EMERGENCY OPENING FACILITY

CROSS-REFERENCE TO RELATED APPLICATIONS

The entire disclosure of United Kingdom Patent Application No. 0414935.7 filed on Jul. 2, 2004 is incorporated herein by reference in its entirety.

BACKGROUND

1. Field of the Invention

The present invention relates to a slide fastener with an emergency or quick opening facility.

2. Description of the Related Art

It is known to modify a zip fastener construction so that the fastener can be opened without recourse to the slider. This has been achieved by omitting elements from a length of the fastener chain, on one or both tapes, such as shown in GB-A-678,755, GB-A-1480176 and GB-A-1514296 for example.

To prevent inadvertent opening of the fastener the sides may be reinforced to reduce flexibility at the omitted element as in GB-A-1480176 and GB-A-1514296. In GB-A-678755 a breakable connection bridges the tapes. U.S. Pat. No. 3,122,808 shows a quick release fastener using a clip.

We are particularly interested in providing a zip fastener with an emergency or quick release opening for use with an automobile air bag assembly. WO00/35719 shows a fastener using mushroom type engaging elements and a breakable sleeve for use with an air bag.

Side air bags in automobiles are typically housed in the seat back. On inflation, the bag bursts through an opening in the seat cover. This opening may be provided by a stitched seam, the stitching breaking. In another system plastic strips are sewn to the seat fabric and coupled to the air bag container. When the air bag inflates the air bag container opens, allowing the strips to separate.

With a stitched seam, inspection of the air bag assembly is difficult, as the seam must be re-sewn. With the plastic strips the assembly is complex and relatively expensive.

Accordingly, an object of our invention is to provide a zip fastener with a quick release or emergency release facility provided by modification of the fastener elements. At least one of the fastener elements is modified to facilitate disengagement of the coupled elements under the force of the expanding air bag. Typically two or more adjacent elements will be modified.

When used in a vehicle seat cover, the fastener should withstand forces tending to open the fastener in normal use, such as tension in the plane of the fastener, particularly tension applied across the line of the coupled elements. Thus, another object of our invention is to provide a modified fastener element which resists separation of the fastener under these conditions.

The fastener may also be subject to out of plane movement, for example by a person or child pressing the fastener inwards, into the seat. Thus, yet another object of our invention is to provide a modified fastener element which resists separation of the coupled elements when pressed in one direction transverse to the fastener plane, but allows separation when pressed in the opposite direction.

We particularly prefer to use a zip fastener having moulded plastics elements. The moulded plastics elements in standard form have a body which is moulded onto an edge of the fastener tape, a neck extending from the body and a head on the outer end of the neck. The neck forms a narrow or waisted region between the head and body.

The head of a fastener element fits between the necks of two adjacent elements on the opposite fastener tape to prevent separation of the coupled elements.

A shoulder is provided adjacent the element neck and cooperates with a groove in the head of an opposed element to limit out of plane movement of the fastener heads.

SUMMARY

Thus, in accordance with one preferred aspect of the present invention, a zip fastener comprises a pair of tapes having a plurality of fastener elements of the type described mounted on an edge of the tape, wherein a modified element is provided on one tape, the modified element having a head which bears on a shoulder of an opposed element when urged in a first direction transverse to the plane of the tape, and passes the shoulder when urged in a second direction opposite to the first direction.

Preferably the head of a modified element is asymmetrical about a plane of the fastener tape.

Preferably the modified elements appear identical to the other elements when viewed from one side, the outer side, of the fastener chain.

Preferably at least two modified elements are provided. Preferably two modified elements are adjacent each other on a tape and/or one is adjacent a like element on the opposed tape.

Preferably the elements are formed of plastics material and insert moulded on a tape edge. In this way it is possible to mould a length of fastener stringer with a small number of modified elements.

DESCRIPTION OF THE DRAWINGS

The invention will be further described by way of example with reference to the accompanying drawings, in which.

DETAILED DESCRIPTION OF THE INVENTION

Figure 1:
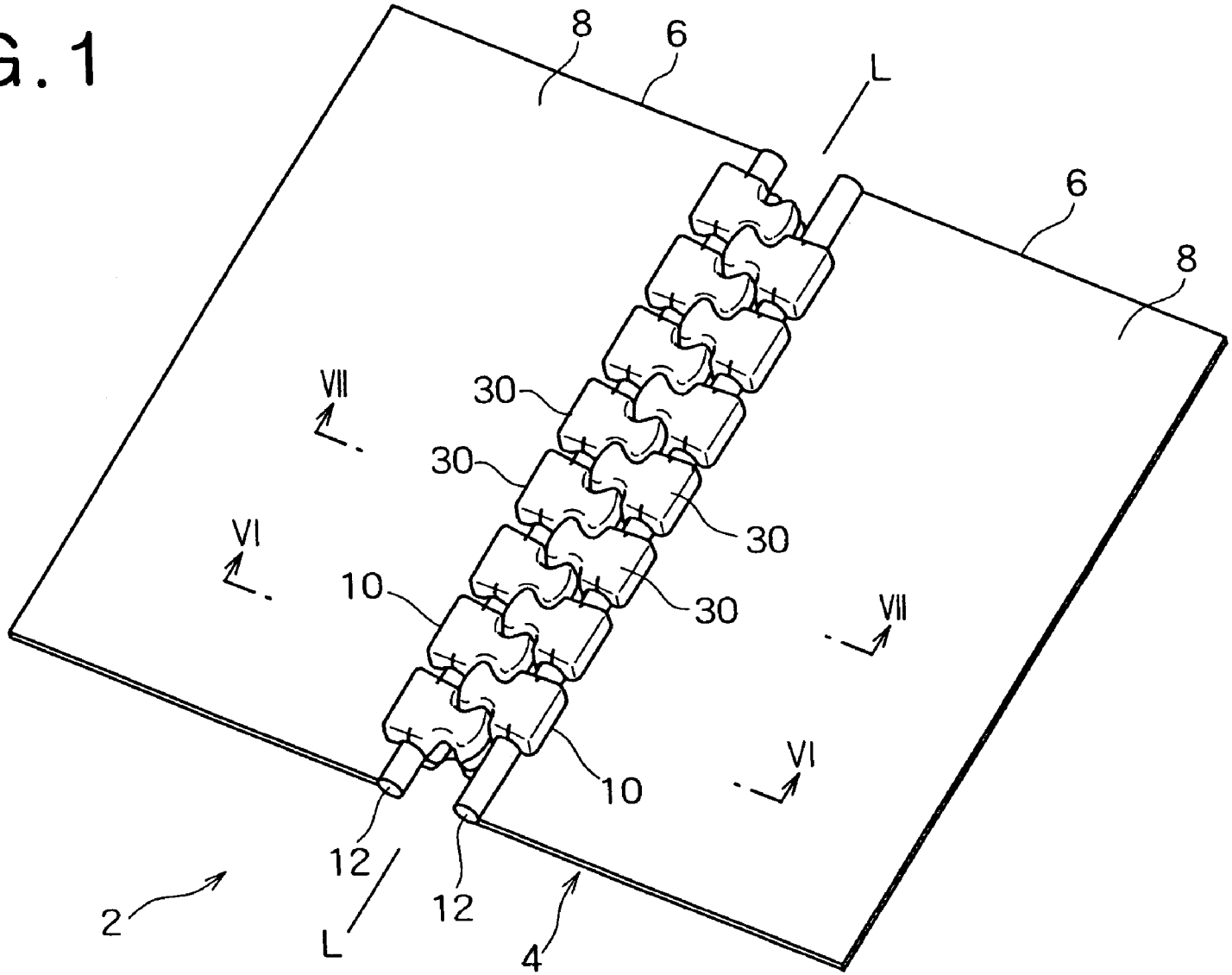
FIG. 1 is a perspective view from an outer side of a zip fastener embodying the invention.

FIG. 1 shows a portion 2 of a zip fastener 1 having an emergency or quick opening facility in accordance with the invention. The zip fastener has particular utility for a covering of a vehicle air bag, such as a car seat cover when the bag is mounted in the car seat.

To a large extent the zip fastener is of conventional construction and manufacture as exemplified by the VISLON (trademark) zip fastener of YKK Corporation. The fastener comprises a chain 4 having two stringers 6 each comprising a tape 8 which may be of fabric material, with a plurality of fastener elements 10 insert moulded on a cord 12 at the tape edge. The fastener is closed by engaging the coupling elements 10 of the respective stringers 6 using a slider (not shown). The slider may be permanently mounted on the chain 4 but we prefer to use a removable slider.

Figure 6:
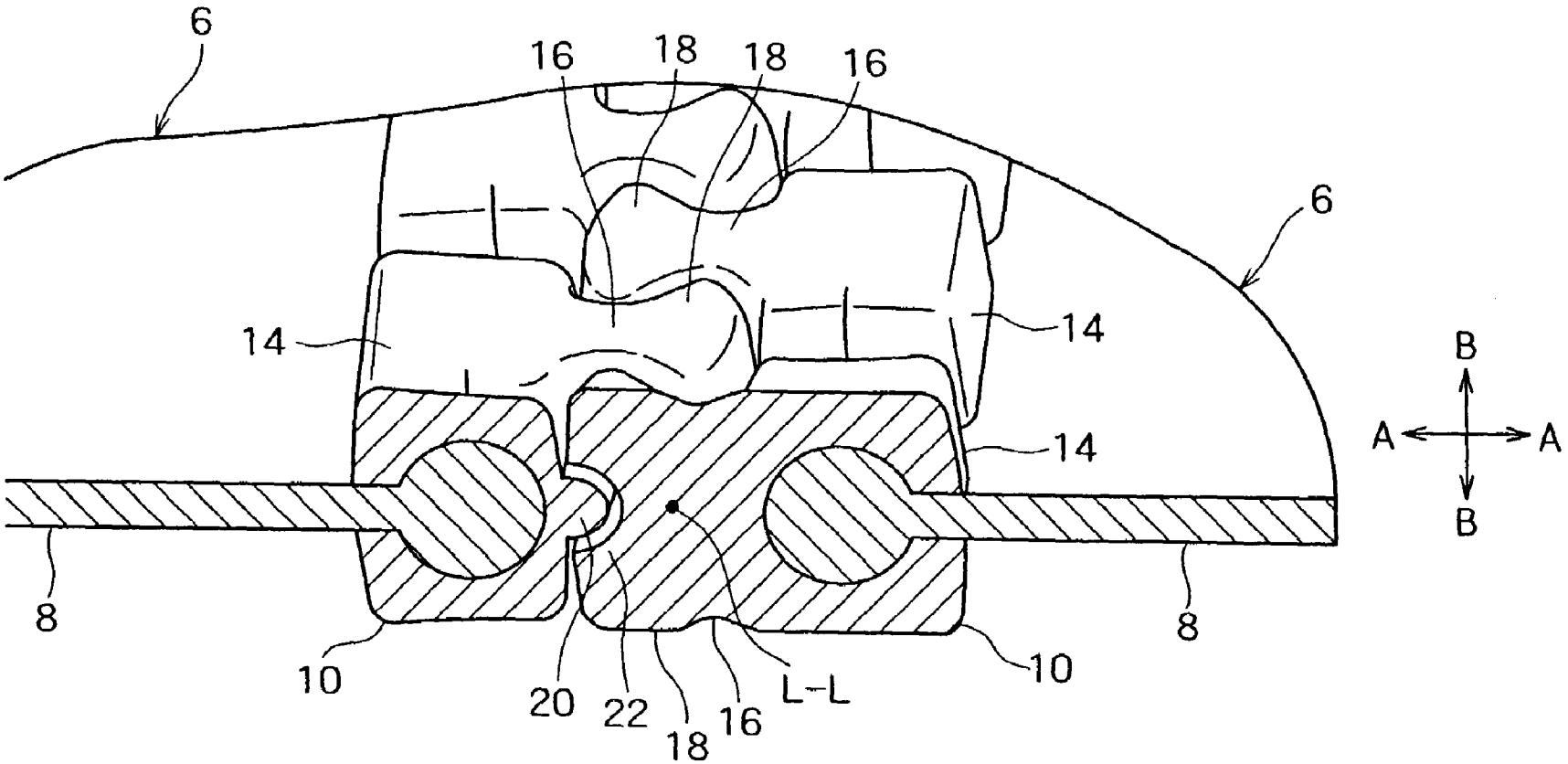
FIG. 6 is a cross-section along the line VI-VI of FIG. 1.

Referring to FIGS. 1 and 6, the elements 10 comprise a body portion 14 which embraces the cord edge 12, a waisted portion formed by a neck 16 and a head 18. As well known in the art, the necks 16 and heads 18 interlock to prevent separation of the fastener stringers unless peeled apart in the plane of the tapes by a slider, for example. To prevent separation of the elements 10 by relative movement transverse to the plane of the tapes 8, a shoulder 20 is provided on the body 14 to engage in a co-operating groove 22 in the end of the opposed head 18. The element 10 is called a second element.

Thus the fit of each head 18 and neck 16 of an element 10 between the head 18 and neck 16 of the adjacent elements 10 of the opposite stringer 6 together with the co-operation of the shoulder 20 and groove 22 serves to limit relative movement of the elements 10 in the plane of the tapes, particularly in the direction A-A transverse to the line L-L of the elements, and also perpendicular to the plane, direction B-B. The fit also inhibits twisting movement out of the plane of the tapes, in particular folding of the fastener about the line L-L of the elements.

It is well known that if sufficient force is applied to a zip fastener the elements can be parted. Once one or a few elements are parted it is relatively easy to disengage the remaining elements as they can be peeled apart.

Figure 2:
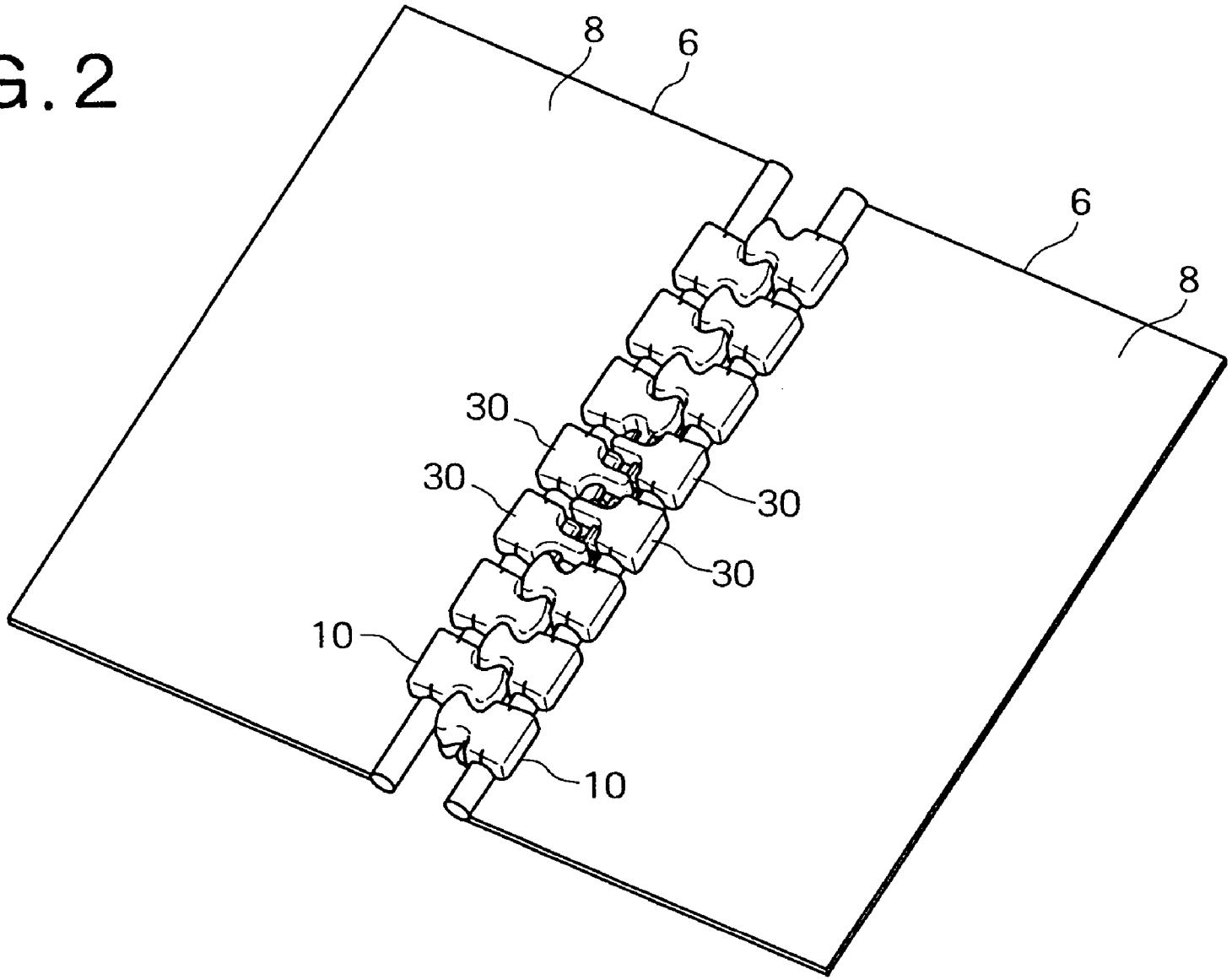
FIG. 2 is a perspective view from the inner side of the zip fastener of FIG. 1.
Figure 3:
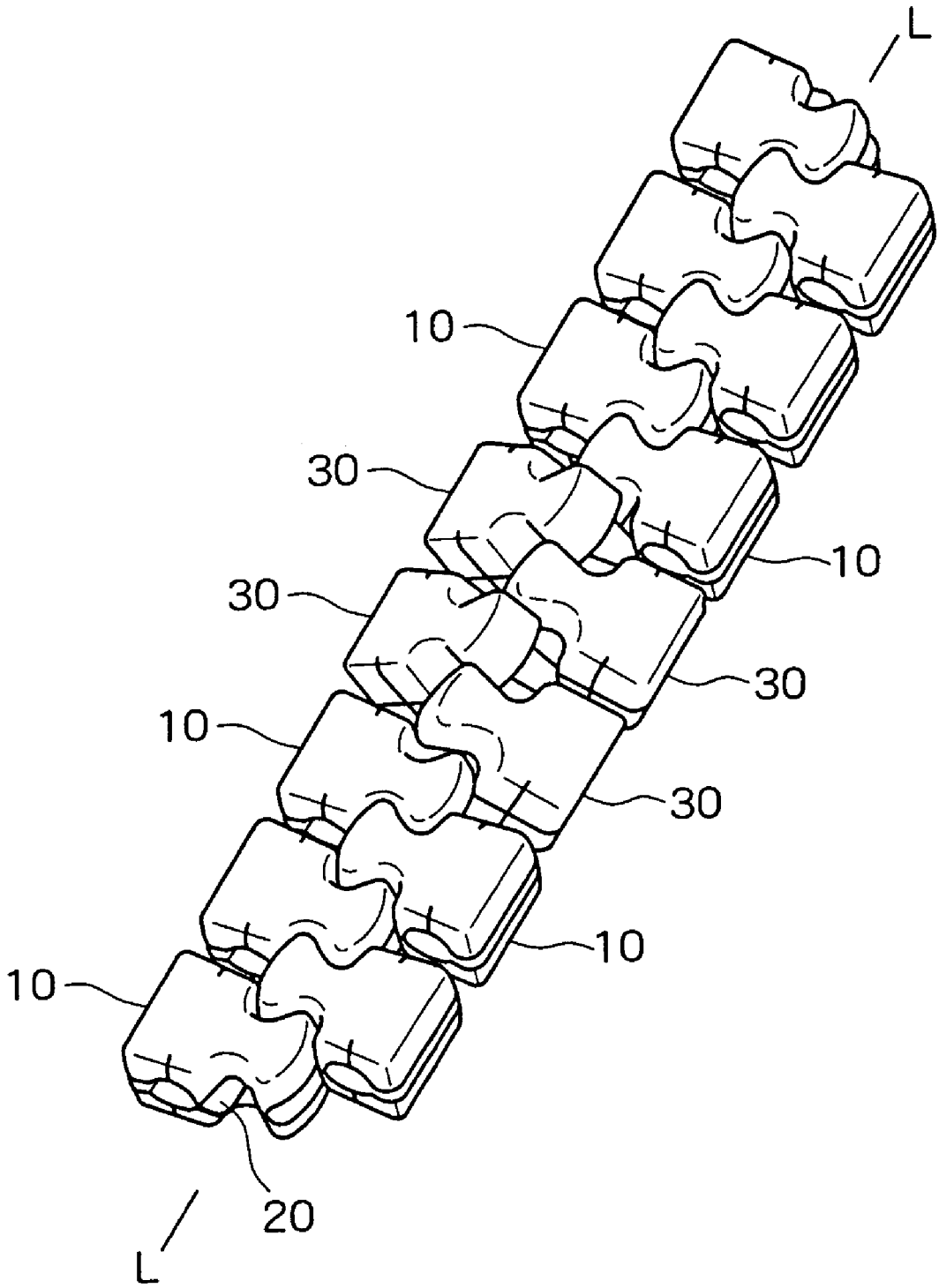
FIG. 3 is an outer view of the coupling elements of the zip fastener of FIG. 1 when bulged outwardly.
Figure 4:
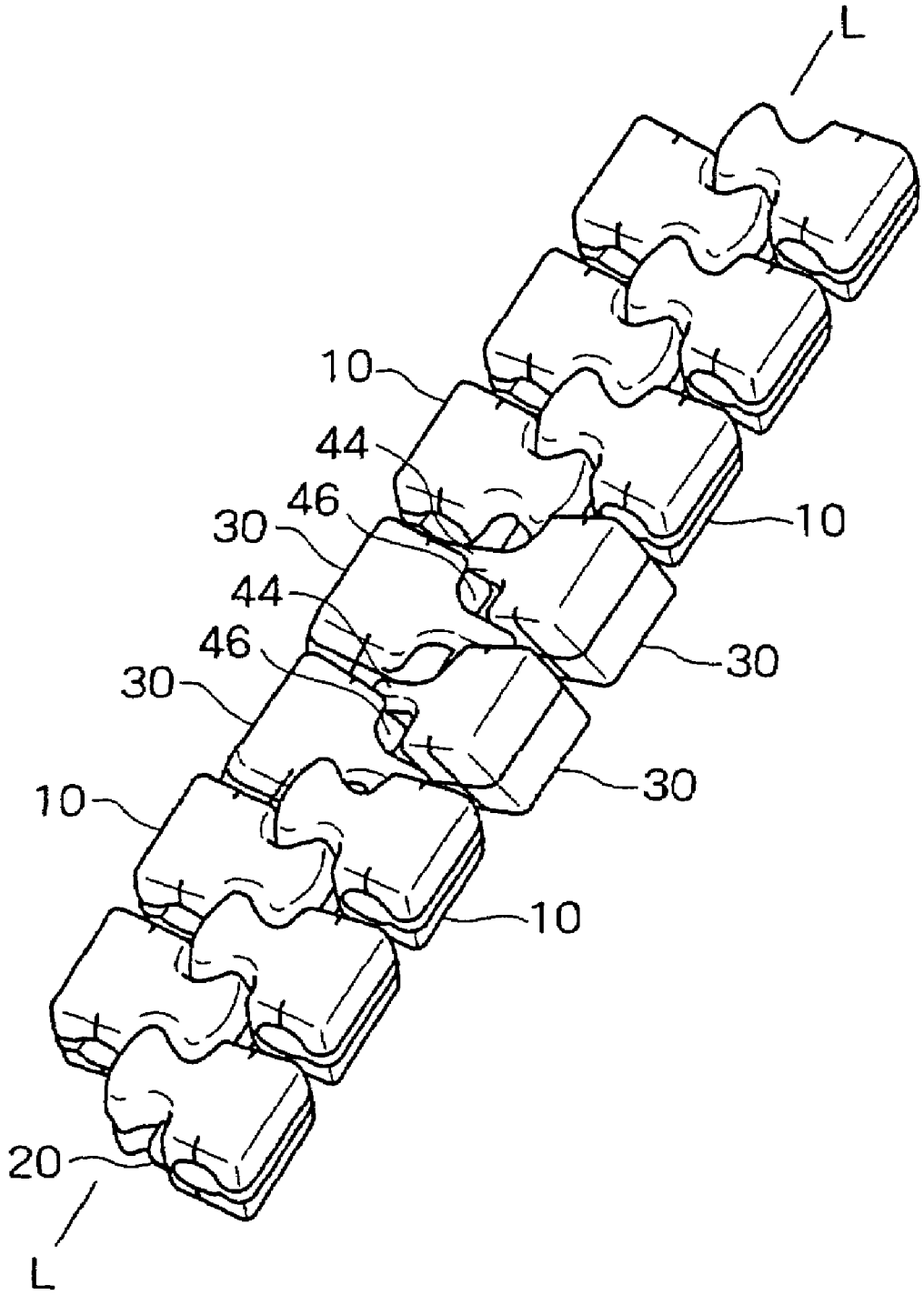
FIG. 4 is an inner view of the coupling elements of the zip fastener of FIG. 1 when bulged outwardly.
Figure 7:
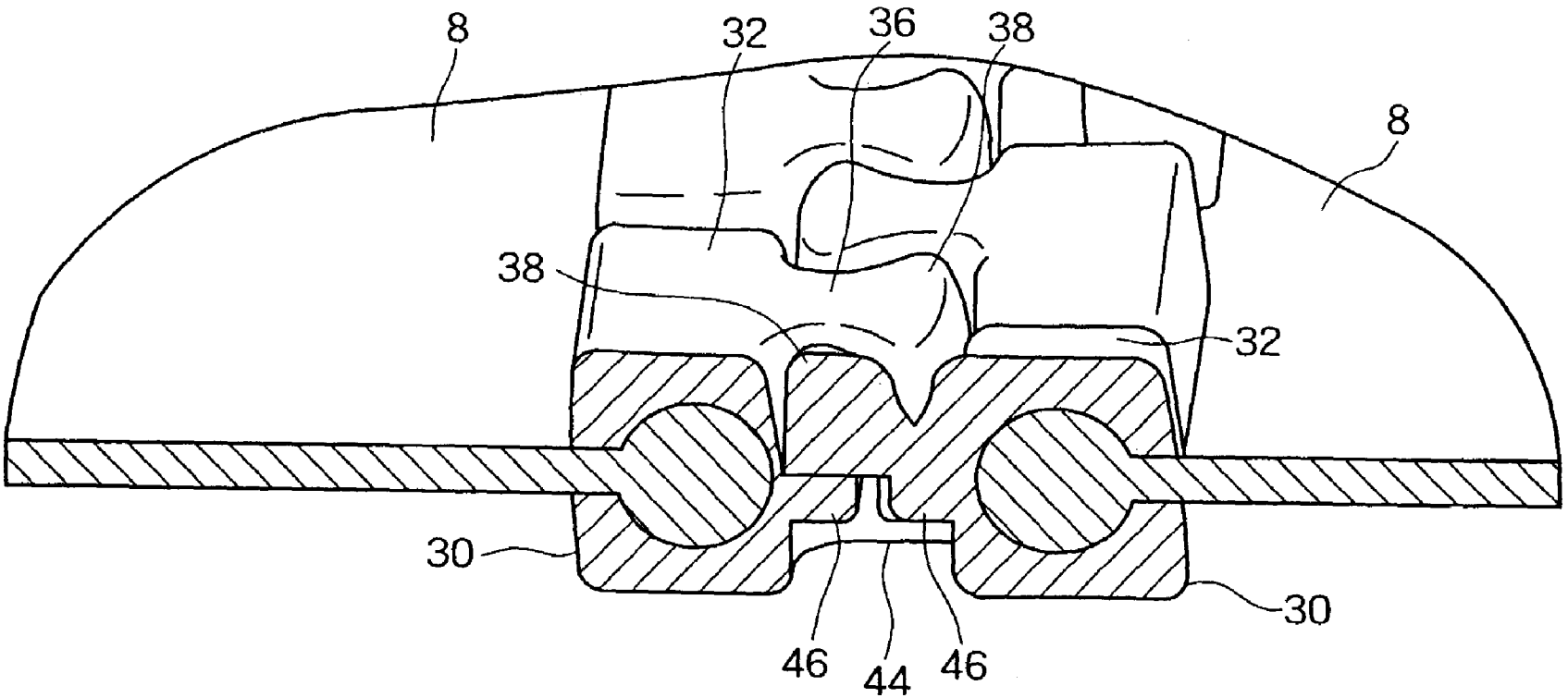
FIG. 7 is a cross-section along the line VII-VII of FIG. 1.

Referring to FIGS. 2 and 7 in particular, the fastener portion 2 has four elements 30 with a different or modified configuration. The elements 30 allow the chain 6 to be folded to a greater extent about the line L-L as shown in FIGS. 3 and 4. This greater degree of flexibility makes it possible to peel apart the rows of elements 10 starting at the region of weakness formed by the elements 30. As indicated above the elements 30 are configured to allow greater flexing in one direction only.

As seen in FIG. 1, each element 30 has a first head which, as viewed in plan view from above or the outer side, is similar to the head 18 of each second element 10, providing a good visual appearance. The element 30 is called a first element in order to distinguish it from the second element. From the inner side, FIG. 2, a second head portion of the first elements 30 is a narrow projection or nose which will pass between the shoulders of adjacent elements, as will be described hereinafter.

Element 30 comprises a body portion 32 which is symmetrical about a median plane which is the plane of the fastener tape. Extending from the upper half 34 of the body 31 there is a neck 36 and head 38. The lower half of the element 30 has a neck 42 which extends into a narrow nose 44. A shoulder 46 extends either side of the neck 42.

Referring to FIG. 1, the head 38 and neck 36 of the elements 30 engages with the head and neck of adjacent elements 30 and/or 10 to inhibit separation in the plane of the tapes 6. Head 38 is similar in plan view to the head 18 of an element 10. It may be the same size but is preferably smaller to allow greater freedom of movement.

Figure 5B:
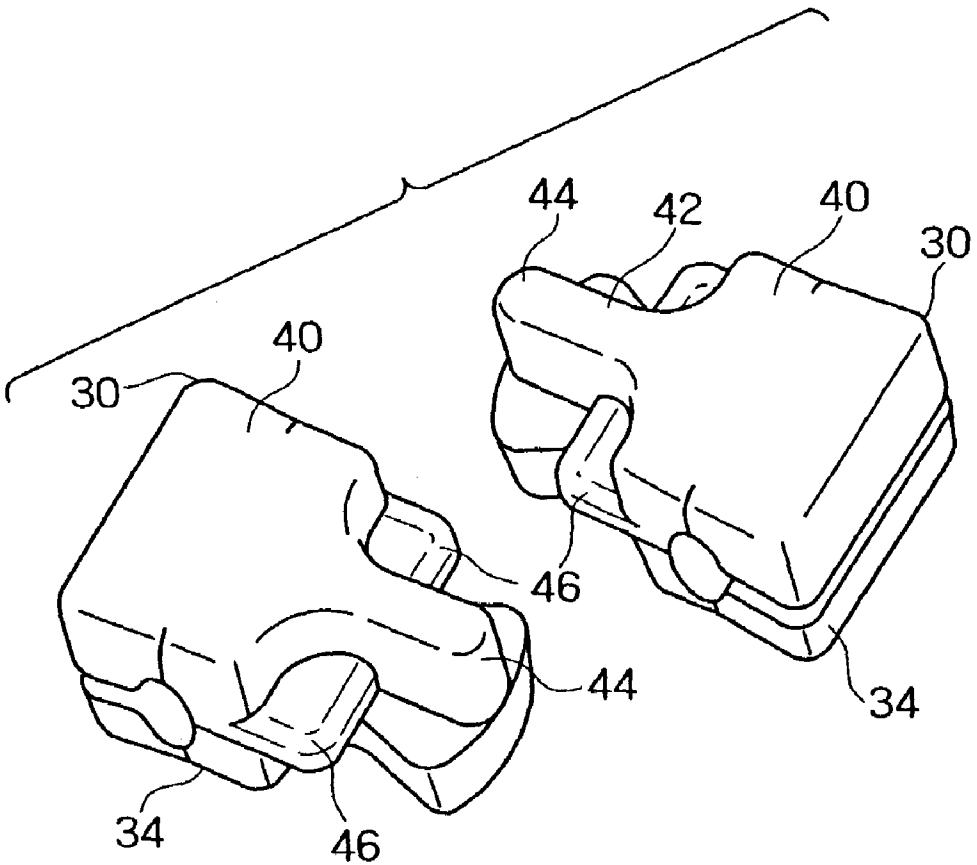
FIGS. 5*a* and 5*b* are perspective views of pairs of modified coupling elements from above and below.
Figure 5A:
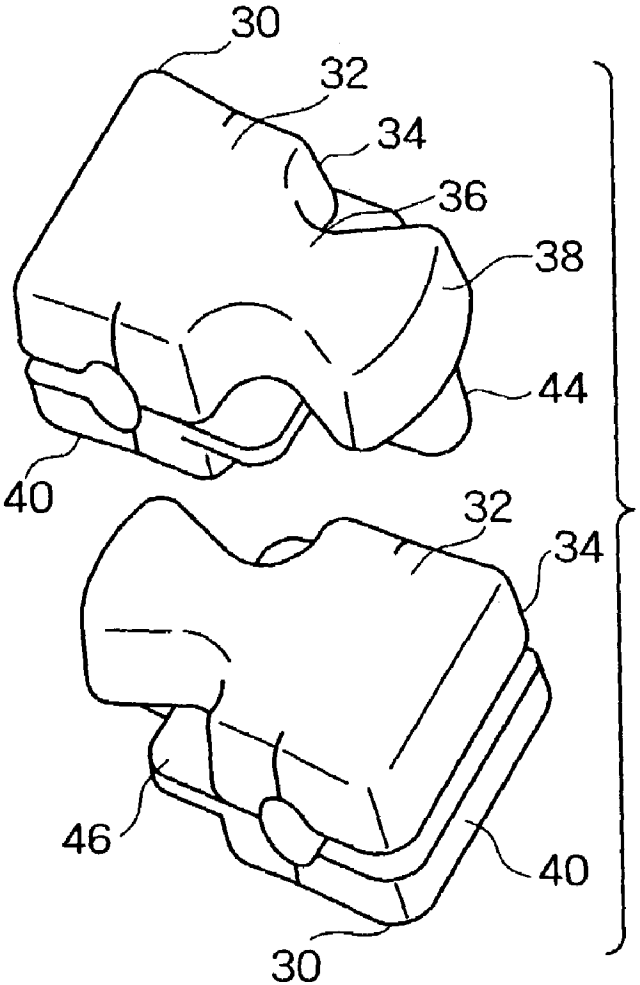

Referring to FIGS. 5 and 7, the upper body head 38 of an element 30 will rest on the shoulder 46 of an adjacent element 30 thus resisting any inward force (that is downwards as seen in FIG. 7, or a first direction transverse to the plane of the tape). However, the nose 44 passes between the shoulders 46 of the opposite elements 30, and so there is less resistance to an outward force (upwards as seen in FIG. 7, or a second direction opposite to the first direction). Also the nose portion 44 will not engage an oppose head 18.

The nose 44 sits between the shoulders 46 and limits the flexing of the fastener chain if it is curled or rolled up, about a line in the fastener plane transverse to the fastener elements.

Where an element 30 engages with an opposed element 10, the shoulders 20 of the element 10 may be cut away to accommodate the head 30, or head 38 may be cut away to accommodate the shoulder 20.

Thus the line of engaged elements can be flexed more easily, in one direction only, at the coupling elements 30, providing a point of weakness at which the zip fastener can be peeled open while maintaining a uniform appearance for the fastener when viewed from one direction. Also, the fastener can be opened and closed in the normal manner using a slider.

Figure 8:
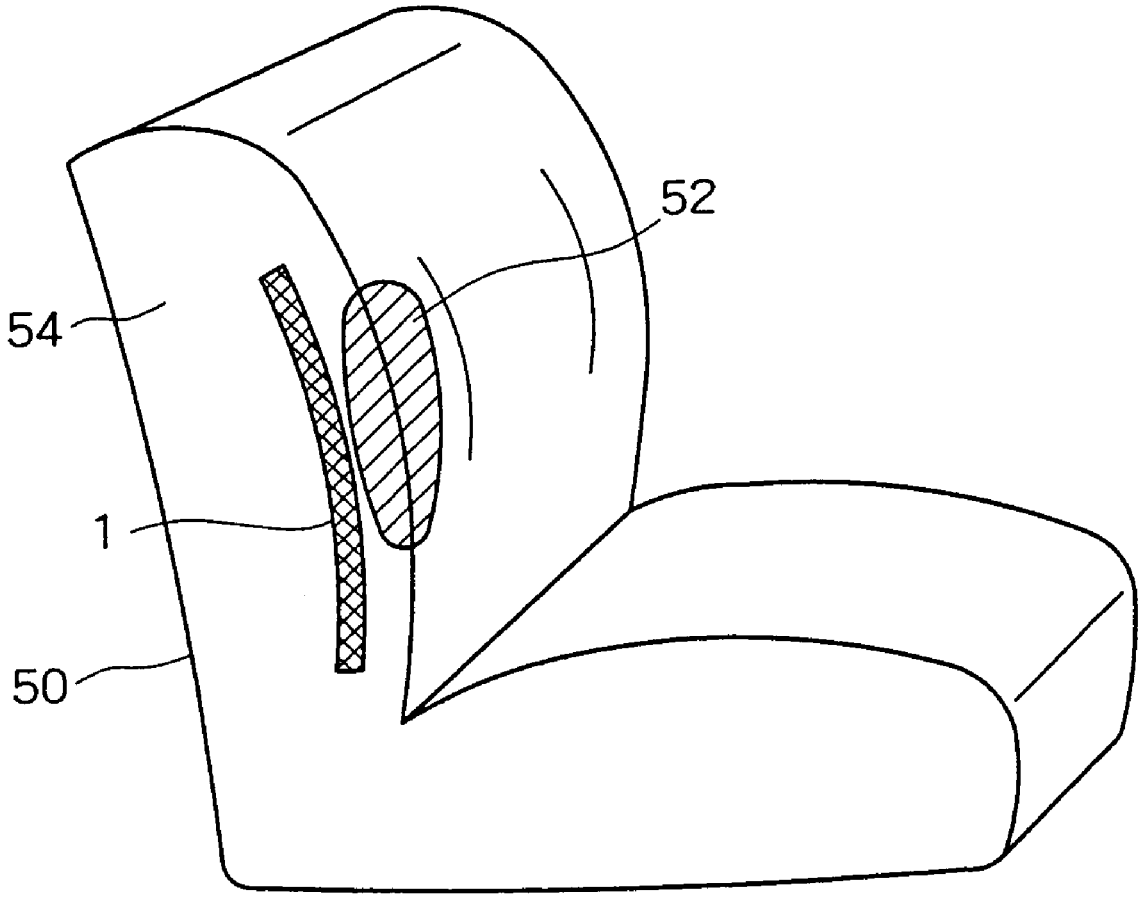
FIG. 8 shows the zip fastener of FIG. 1 mounted in a car seat cover.

FIG. 8 shows a fastener of this invention mounted in a car seat cover. The car seat 50 has an air bag 52 mounted in the back rest 54 as well known in the art. A zip fastener 1 incorporating a weakened portion as described above is sewn into the car seat cover to provide a burstable opening for the air bag 52 to expand through. The zip fastener 1 is mounted with the inner side (the side seen in FIG. 2) facing inwards towards the air bag. The outer side of the fastener (seen in FIG. 1) presents the look of a normal zip fastener and faces outwards. Any tension in the plane of the fastener or any pressure on the fastener from outside of the seat is resisted in the usual way by the interlocking fastener heads 18, 38 and shoulders 20, 46. When the air bag explodes, the bag presses on the zip fastener and fastener will readily flex outwards at the elements 30 and subsequently the elements 30, 10 will peel apart.

CONCLUSION, RAMIFICATIONS, AND SCOPE

Although we have particularly described the use of the fastener with an air bag, the fastener has other uses where a quick or emergency opening is required. The elements 30 may be colour coded to assist identification of the 'weak spot'. Also, the number of elements 30 may be varied to vary the weakness of the fastener. A greater number of elements 30 will provide greater flexibility in the outward direction. The fastener tape may be of moulded or extruded plastics material, and the element may be integrally moulded with the tape.

It will be appreciated that when we refer to the plane of the fastener we are referring generally to the plane of the fastener elements in their normal orientation.

Although the description above contains many specificities, these should not be construed as limiting the scope of the invention but as merely providing illustrating of some of the presently preferred embodiments of this invention.

Thus the scope of the invention should be determined by the appended claims and their legal equivalents, rather than by the examples given.

What is claimed is:

1. A zip fastener comprising a pair of tapes having a plurality of coupling elements provided on an edge of each tape, wherein a first element on one tape has a head which bears on a shoulder of an opposed element on the other tape when urged in a first direction transverse to a plane of the tape preventing the head from passing the shoulder of the opposed element in the first direction, and passes the shoulder when urged in a second direction opposite to the first direction;

wherein the head of the first element has a first head portion which, in use, engages between head portions of two adjacent opposed elements on the other tape to prevent separation of the tapes in the plane of the tapes, the first head portion bearing on the shoulder provided on the opposed elements, and a second head portion which is smaller than the first head portion and passes the shoulders on the opposed elements.

2. A zip fastener as claimed in claim 1, wherein the opposed element is a second element and the first element appears similar to the second element when viewed from one side of the fastener.

3. A zip fastener as claimed in claim 1, wherein at least two first elements are provided.

4. A zip fastener as claimed in claim 3, wherein the two elements are adjacent one another.

5. A zip fastener as claimed in claim 4 wherein at least three first elements are provided, two elements being adjacent one another on a first tape edge, and the third element being provided on the other tape edge and interlocking with the other two elements.

6. A zip fastener as claimed in claim 1, comprising a plurality of second elements is provided on an edge of each tape, each second element having a head which bears on a shoulder of an opposed element when urged in the first direction and the second direction.

* * * * *